US009480304B2

(12) United States Patent
Taniguchi et al.

(10) Patent No.: US 9,480,304 B2
(45) Date of Patent: Nov. 1, 2016

(54) SPIKE SOLE REINFORCED BY FIBER REINFORCEMENT

(75) Inventors: Norihiko Taniguchi, Kobe (JP); Shigeru Hibino, Gifu (JP); Koki Matsuo, Kobe (JP)

(73) Assignee: ASICS CORPORATION, Kobe-Shi (JP)

( * ) Notice: Subject to any disclaimer, the term of this patent is extended or adjusted under 35 U.S.C. 154(b) by 327 days.

(21) Appl. No.: 14/002,073

(22) PCT Filed: Mar. 18, 2011

(86) PCT No.: PCT/JP2011/056539

§ 371 (c)(1), (2), (4) Date: Aug. 28, 2013

(87) PCT Pub. No.: WO2012/127556

PCT Pub. Date: Sep. 27, 2012

(65) Prior Publication Data

US 2013/0333251 A1 Dec. 19, 2013

(51) Int. Cl.

*A43B 13/26* (2006.01)
*A43B 5/02* (2006.01)

(Continued)

(52) U.S. Cl.

CPC ..... *A43B 13/26* (2013.01); *A43B 5/02* (2013.01); *A43B 5/06* (2013.01); *A43B 7/145* (2013.01);

(Continued)

(58) Field of Classification Search

CPC .... A43B 13/22; A43B 13/26; A43B 13/026; A43B 13/12; A43B 13/122; A43B 5/001; A43B 5/06; A43B 5/14; A43B 13/125; A43B 13/127; A43B 13/16; A43B 5/02; A43B 7/1425; A43B 7/1435; A43B 7/1445; A43B 7/145; A43B 7/1475; A43C 15/00; A43C 15/005; A43C 15/02

USPC ..... 36/67 A, 129, 30 R, 31, 38, 128

See application file for complete search history.

(56) References Cited

U.S. PATENT DOCUMENTS 1,392,704 A * 10/1921 Pierce ..... A43C 15/167 152/210
2,070,269 A * 2/1937 Goldenberg ..... A43C 13/04 36/108

(Continued)

FOREIGN PATENT DOCUMENTS

| | | | |
|---|---|---|---|
| EP | 0724952 | A1 | 8/1996 |
| JP | 2000102402 | A | 4/2000 |
| JP | 2002125709 | A | 5/2002 |

OTHER PUBLICATIONS

Partial Supplementary European Search Report issued in European Application No. 11861890.9, dated Dec. 22, 2014.

*Primary Examiner* — Anna Kinsaul
*Assistant Examiner* — Griffin Hall
(74) *Attorney, Agent, or Firm* — Mintz Levin Cohn Ferris Glovsky and Popeo, P.C.

(57) ABSTRACT

An FRP-made spike sole of the present invention has a plurality of spikes in a front foot portion, wherein: at least one layer of a main reinforcement sheet which is arranged spanning from a front end of the front foot portion to a rear end of a middle foot portion and made of fiber reinforcement coated with a matrix resin is laminated with a layer of a first cut-off sheet which is absent at least in an area in the vicinity of the front end of the front foot portion and which is arranged in the middle foot portion and made of fiber reinforcement coated with a matrix resin; and a front end of the first cut-off sheet is positioned posterior to a front end of a proximal phalanx of a big toe and anterior to a base of the metatarsal bone of the big toe.

14 Claims, 8 Drawing Sheets

(51) Int. Cl.

| | |
|---|---|
| ***A43B 7/14*** | (2006.01) |
| ***A43C 15/00*** | (2006.01) |
| ***A43C 15/02*** | (2006.01) |
| ***A43B 13/02*** | (2006.01) |
| ***A43B 5/06*** | (2006.01) |

(52) U.S. Cl.

CPC ..... *A43B 7/1425* (2013.01); *A43B 7/1435* (2013.01); *A43B 7/1445* (2013.01); *A43B 7/1475* (2013.01); *A43B 13/026* (2013.01); *A43C 15/005* (2013.01); *A43C 15/02* (2013.01)

(56) References Cited

U.S. PATENT DOCUMENTS 2,203,929 A * 6/1940 Shapiro ..... A43B 5/06 36/134
4,361,971 A * 12/1982 Bowerman ..... A43B 5/06 36/129
4,393,604 A * 7/1983 Crowley ..... A43C 15/162 36/126
4,507,879 A * 4/1985 Dassler ..... A43B 5/02 36/102
4,546,559 A * 10/1985 Dassler ..... A43B 5/06 36/114
4,559,724 A * 12/1985 Norton ..... A43B 5/06 36/114
4,564,966 A * 1/1986 Chen ..... A43B 1/0027 12/146 B
4,574,498 A * 3/1986 Norton ..... A43B 23/17 36/114
4,782,604 A * 11/1988 Wen-Shown ..... A43B 5/001 36/127
4,914,838 A * 4/1990 Ihlenburg ..... A43B 13/141 36/102
5,197,210 A * 3/1993 Sink ..... A43B 13/26 36/127
5,406,723 A * 4/1995 Okajima ..... A43B 5/14 36/131
5,452,526 A * 9/1995 Collins ..... A43B 1/0072 36/108
5,473,827 A * 12/1995 Barre ..... A43B 5/02 36/128
5,533,282 A * 7/1996 Kataoka ..... A43B 5/06 36/129
5,832,636 A * 11/1998 Lyden ..... A43B 5/02 36/127
5,918,338 A 7/1999 Wong
5,987,783 A * 11/1999 Allen ..... A43B 5/001 36/102
5,987,784 A * 11/1999 Bignell ..... B29D 35/122 36/127
6,061,931 A * 5/2000 Kaneko ..... A43B 1/0009 36/129
6,199,302 B1 3/2001 Kayano
6,212,795 B1 4/2001 Nakabe et al.
6,256,907 B1 * 7/2001 Jordan ..... A43C 15/14 36/134
6,367,167 B1 * 4/2002 Krstic ..... A43B 5/02 36/25 R
6,438,870 B2 8/2002 Nasako et al.
6,467,191 B2 10/2002 Hayashi et al.
6,467,197 B1 10/2002 Mitsui et al.
6,516,539 B2 2/2003 Nishiwaki et al.
6,647,646 B2 11/2003 Mitsui et al.
6,685,011 B2 2/2004 Nishiwaki et al.
6,763,615 B2 7/2004 Mitsui et al.
D495,859 S 9/2004 Kubo et al.
D495,860 S 9/2004 Kubo et al.
D496,148 S 9/2004 Kayano et al.
6,789,333 B2 9/2004 Nishiwaki et al.
D501,713 S 2/2005 Kayano et al.
D501,987 S 2/2005 Kubo et al.
6,935,055 B2 * 8/2005 Oorei ..... A43B 5/001 36/129
D509,351 S 9/2005 Kayano et al.
D512,208 S 12/2005 Kubo et al.
D512,818 S 12/2005 Mitani et al.
D512,819 S 12/2005 Usuki et al.
D512,827 S 12/2005 Usuki et al.
D512,828 S 12/2005 Kubo et al.
D513,115 S 12/2005 Kayano et al.
6,973,746 B2 * 12/2005 Auger ..... A43B 1/0072 36/128
D514,286 S 2/2006 Kayano et al.
D520,732 S 5/2006 Mitani et al.
D522,229 S 6/2006 Kubo et al.
7,082,699 B2 8/2006 Nishiwaki et al.
7,111,415 B2 * 9/2006 Hockerson ..... A43B 5/06 36/102
7,181,868 B2 * 2/2007 Auger ..... A43B 5/02 36/103
D542,522 S 5/2007 Fujita et al.
7,254,907 B2 8/2007 Nishiwaki et al.
D552,833 S 10/2007 Yamashita et al.
D553,846 S 10/2007 Kayano et al.
7,322,131 B2 1/2008 Yamashita et al.
D561,434 S 2/2008 Fujita et al.
D561,442 S 2/2008 Kayano et al.
7,325,323 B2 2/2008 Katsu et al.
7,325,336 B2 2/2008 Yamashita et al.
D571,086 S 6/2008 Yamashita et al.
D571,090 S 6/2008 Fujita et al.
7,380,354 B2 6/2008 Yamashita et al.
D575,486 S 8/2008 Yamashita et al.
D575,946 S 9/2008 Mitani et al.
D582,658 S 12/2008 Fujita et al.
7,673,400 B2 * 3/2010 Brown ..... A43B 5/001 36/127
7,779,558 B2 8/2010 Nishiwaki et al.
7,877,899 B2 2/2011 Nishiwaki et al.
7,971,374 B2 * 7/2011 Hernandez ..... A43B 1/0081 36/129
7,987,618 B2 8/2011 Nishiwaki et al.
8,008,363 B2 8/2011 Mori et al.
D650,566 S 12/2011 Yamashita et al.
8,074,377 B2 12/2011 Nishiwaki et al.
8,112,909 B2 2/2012 Kubo et al.
8,356,428 B2 * 1/2013 Auger ..... A43B 5/02 36/102
8,418,379 B2 4/2013 Nishiwaki et al.
8,453,344 B2 6/2013 Nishiwaki et al.
8,461,222 B2 6/2013 Mori et al.
8,544,190 B2 10/2013 Nishiwaki et al.
8,613,149 B2 * 12/2013 Schwirian ..... A43B 5/14 36/103
8,713,819 B2 * 5/2014 Auger ..... A43B 5/02 36/102
2004/0148809 A1 * 8/2004 Kikuta ..... A43B 5/14 36/131
2008/0010863 A1 * 1/2008 Auger ..... B29D 35/142 36/107
2008/0216352 A1 * 9/2008 Baucom ..... A43B 13/026 36/83
2008/0216355 A1 * 9/2008 Becker ..... A43B 13/026 36/102
2008/0289220 A1 * 11/2008 Rivas ..... A43B 3/0036 36/88
2010/0005684 A1 1/2010 Nishiwaki et al.
2010/0050475 A1 * 3/2010 Benz ..... A43B 5/02 36/103
2011/0197468 A1 8/2011 Kubo et al.
2012/0216422 A1 8/2012 Ikezawa et al.

* cited by examiner

SPIKE SOLE REINFORCED BY FIBER REINFORCEMENT

CROSS-REFERENCE TO RELATED APPLICATIONS

This application is a U.S. national phase application under 37 U.S.C. §371 of Patent Cooperation Treaty Application No. PCT/JP2011/056539, filed on Mar. 18, 2011, entitled Spike Sole Reinforced by Fiber Reinforcement, the contents of which are incorporated by reference herein.

TECHNICAL FIELD

The present invention relates to a spike sole reinforced with fiber reinforcement.

BACKGROUND ART

By forming a sole with a layer of fiber reinforcement coated with a matrix resin, i.e., a pre-preg, the rigidity of the sole is increased and the weight of the sole is reduced. The weight reduction of such a spike sole is important in football sports, or the like, as well as with track and field spike shoes.

It is well known to use a layer of the fiber reinforcement sheet to form a sole having spike pins (the first and second patent documents).

CITATION LIST

Patent Literature

[First Patent Document] JP2000-102402A (Abstract)
[Second Patent Document] JP2002-125709A (Abstract)

SUMMARY OF INVENTION

Technical Problem

Areas of a sole where spikes are provided are subject to a substantial leg power while running through the spikes. Therefore, normally, the flexural rigidity of a sole in the front foot portion thereof tends to be high.

However, since a front foot portion of a sole bends while running, the flexural rigidity thereof should be made lower than that of a middle foot portion. Nevertheless, the patent documents identified above fail to give any such disclosure.

Thus, it is an object of the present invention to easily realize a spike sole reinforced with fiber reinforcement, wherein the flexural rigidity of the front foot portion is less than that of the middle foot portion.

The patent documents identified above fail to give any disclosure as to the need to locally reinforce the areas of spike pins with such a sheet.

For example, JP2000-102402A provides truncated cone-shaped protrusions for supporting spike pins. However, such protrusions significantly increase the weight of the sole, inhibiting the weight reduction of the sole.

Thus, it is another object of the present invention to provide a spike sole reinforced with fiber reinforcement, wherein the weight of the sole is reduced while maintaining the strength of the sole.

Solution to Problem

One aspect of the present invention is directed to a spike sole having a plurality of spikes 4 at least in a front foot portion, wherein: at least one layer of a main reinforcement sheet 1 which is arranged spanning from a front end of the front foot portion to a rear end of a middle foot portion and made of a fiber reinforcement coated with a matrix resin is laminated with a layer of a first cut-off sheet 21 which is absent at least in an area in a vicinity of the front end of the front foot portion and which is arranged in the middle foot portion and made of a fiber reinforcement coated with a matrix resin; and a front end of the first cut-off sheet 21 is positioned posterior to a front end of a proximal phalanx B31 of a big toe and anterior to a base of the metatarsal bone B41 of the big toe.

The main reinforcement sheet 1 and the first cut-off sheet 21 are made of a pre-preg including a matrix resin reinforced with fiber reinforcement.

Note that fiber reinforcement refers to a fibrous material having a greater Young's modulus than Young's modulus of a matrix resin.

A matrix resin of a fiber reinforced plastic (FRP) refers to a base material thereof to be combined with the fiber, which is the reinforcing material.

Advantageous Effects of Invention

It is possible to easily realize a sole in which the rigidity of the front foot portion is smaller than that of the middle foot portion.

In a preferred embodiment of this aspect, a second cut-off sheet 22 which is absent at least in an area in the vicinity of the front end of the front foot portion and which is arranged in the middle foot portion and made of fiber reinforcement coated with a matrix resin is laminated with the main reinforcement sheet 1 and the first cut-off sheet 21; a front end of the second cut-off sheet 22 is positioned posterior to a head of the proximal phalanx B31 of the big toe and anterior to the base of the metatarsal bone B41 of the big toe; and the front end of the second cut-off sheet 22 is arranged posterior to the front end of the first cut-off sheet 21.

In such a case, it is possible to easily realize a sole whose rigidity gradually decreases toward the anterior side.

Now, fiber of a pre-preg exerts a very high resistance against a tensile load along the orientation of the fiber, and also exerts a high resistance against a flexural load or twisting. On the other hand, the coat of the matrix resin of a pre-preg is set to a minimum thickness required for the surface adhesion strength between pre-pregs. Therefore, the coat is thin, and therefore the adhesive strength between the pre-preg and the top surface of the spike pin may be insufficient.

From such a point of view, in a more preferred embodiment of this aspect, the main reinforcement sheet 1 is arranged at such a position as to cover over a top surface 42 of a flat-plate-shaped base 40 of the spike 4, and at least one layer of a synthetic resin sheet 6, which is thicker than a thickness of the coat of the matrix resin, is provided between the top surface 42 and the main reinforcement sheet 1 for at least one of the plurality of spikes.

The synthetic resin sheet 6 may be formed by a film-shaped adhesive sheet made of a thermosetting resin.

In such a case, the layer of the synthetic resin sheet 6 increases the adhesion strength between the base 40 of the spike 4 and a pre-preg sheet such as the main reinforcement sheet 1 in contact with the synthetic resin sheet 6. This prevents the base 40 from coming off of the sole.

In a still more preferred embodiment of this aspect, the layer of the synthetic resin sheet 6 is provided in at least a portion of an area where the spikes 4 are provided and is not extending posterior to a base of a metatarsal bone B45 of a fifth toe.

In such a case, the rigidity of the synthetic resin sheet 6 is smaller than that of the main reinforcement sheet 1, and it is therefore possible to easily realize a sole in which the rigidity of the front foot portion is smaller than that of the middle foot portion, and to reduce the weight of the middle foot portion.

In another preferred embodiment of this aspect, at least a portion of the synthetic resin sheet 6 is arranged anterior to the front end of the first cut-off sheet 21, and at least a portion of the synthetic resin sheet 6 is not covered by the first cut-off sheet 21 and is covered by the main reinforcement sheet 1.

In such a case, in portions of the front foot portion where the rigidity is small, the synthetic resin sheet 6 increases the strength of adhesion, thereby preventing the top surface 42 of the spike 4 from coming off.

In still another preferred embodiment of this aspect, a plurality of patches of the synthetic resin sheet 6 are provided in an island-like pattern while being spaced apart from one another in a front-rear direction of a foot.

In such a case, with the provision of a plurality of patches of the synthetic resin sheet 6 separately from one another in the front-rear direction, it is possible to prevent the flexural rigidity of the front foot portion from being unnecessarily high, allowing the sole to bend easily in the areas of separation. Since the area of the synthetic resin sheet 6 is small, the sheet 6 is unlikely to warp (twist), and the sheet 6 can easily be positioned, during the manufacturing process.

In still another preferred embodiment of this aspect, for two or more of the plurality of spikes 4, the synthetic resin sheet 6 is provided separately for each of the spikes 4.

In such a case, it is possible to further reduce the flexural rigidity of the front foot portion.

DESCRIPTION OF EMBODIMENTS

Figure 1:
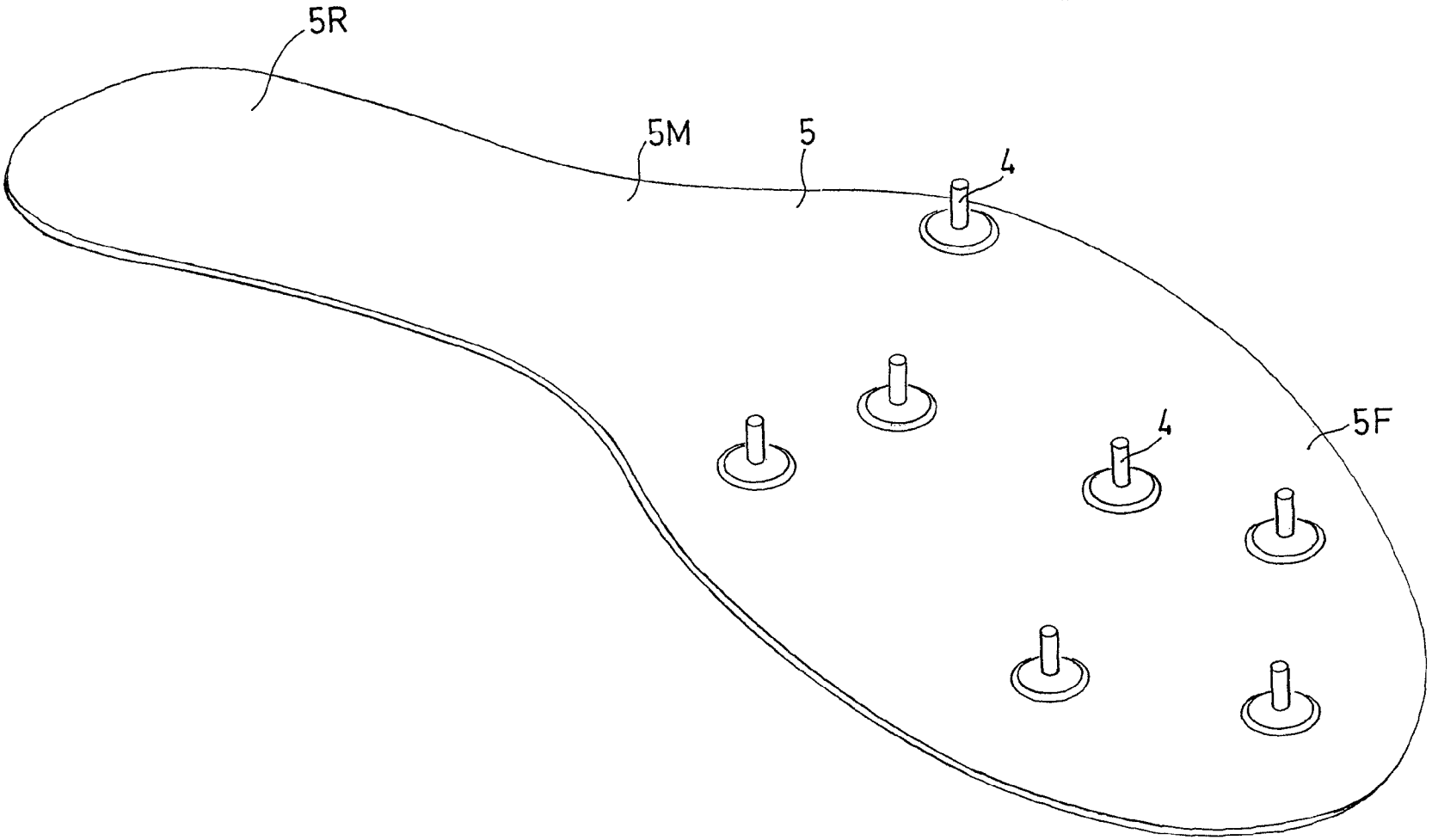
FIG. 1 is a perspective view showing an example of a spike sole according to the present invention.

Another aspect of the method of the present invention is directed to a spike sole having a plurality of spikes 4 at least in a front foot portion, wherein: at least one layer of a main reinforcement sheet 1 which is arranged spanning from a front end of the front foot portion to a rear end of a middle foot portion and made of fiber reinforcement coated with a matrix resin is laminated with layers of a plurality of island-shaped sheets 3 which are arranged separated from one another in an island-like pattern in areas of the spikes 4 and each of which has a greater area than a top surface 42 of each spike 4 and is made of fiber reinforcement coated with a matrix resin.

In this aspect, the island-shaped sheets 3 increase the strength of a sole body 5 at each spike 4.

On the other hand, the island-like pattern of separation prevents the flexural rigidity of the front foot portion from being unnecessarily high, and also allows for a reduction in the weight of the sole.

In a preferred embodiment of this aspect, for two or more of the spikes 4, the island-shaped sheets 3 are provided and are separated from one another in a front-rear direction of a foot.

In such a case, it is possible to further reduce the flexural rigidity of the front foot portion.

In a more preferred embodiment of this aspect, the spike sole includes, further laminated thereto, at least one layer of a cut-off sheet 2 which is absent at least in an area in the vicinity of the front end of the front foot portion and which is arranged in the middle foot portion and made of fiber reinforcement coated with a matrix resin.

In such a case, the rigidity in the area in the vicinity of the front end where the cut-off sheet 2 is absent is smaller than that of the middle foot portion. Therefore, the rigidity of the sole gradually decreases toward the anterior side.

In a more preferred embodiment of this aspect, at least one of the island-shaped sheets 3 is arranged anterior to a front end of the cut-off sheet 2, and at least one of the island-shaped sheets 3 is not covered by the cut-off sheet 2 and is covered by the main reinforcement sheet 1.

In such a case, in portions of the front foot where the rigidity is small, the island-shaped sheets 3 increase the strength of the sole, thereby preventing the spikes 4 from coming off.

In a more preferred embodiment of this aspect, the main reinforcement sheet 1 includes a lower reinforcement sheet 11, being a lower part, and an upper reinforcement sheet 12 covering the lower reinforcement sheet 11 from above; and the cut-off sheet 2 is arranged so as to be sandwiched between the lower reinforcement sheet 11 and the upper reinforcement sheet 12.

Where the cut-off sheet 2 is sandwiched between the lower reinforcement sheet 11 and the upper reinforcement sheet 12, the front end of the cut-off sheet 2 is unlikely to come off of the main reinforcement sheet 1.

In a more preferred embodiment of this aspect, the island-shaped sheets 3 are arranged so as to be sandwiched between the lower reinforcement sheet 11 and the upper reinforcement sheet 12.

In such a case, the spike top surface of the spike 4 is unlikely to come off of the sole.

In a more preferred embodiment of this aspect, the spike includes a flat-plate-shaped base 40 having the top surface 42 and a pin 41 projecting downward from the base 40; and the base 40 is sandwiched between the lower reinforcement sheet 11 and the upper reinforcement sheet 12.

In such a case, the base 40 adheres, directly or indirectly, to both the lower reinforcement sheet 11 and the upper reinforcement sheet 12. Thus, the adhesive strength is high.

In a more preferred embodiment of this aspect, for the plurality of spikes for which the island-shaped sheets 3 are arranged, layers of a plurality of synthetic resin sheets 6 thicker than a thickness of the coat of the matrix resin are provided separately from one another between the top surface 42 and the fiber reinforcement in order to increase an adhesion strength between the fiber reinforcement and the top surface 42.

In such a case, the synthetic resin sheet 6 prevents the base 40 from coming off of the sole.

The present invention will be understood more clearly from the following description of preferred embodiments taken in conjunction with the accompanying drawings. Note however that the embodiments and the drawings are merely illustrative, and should not be relied upon in defining the scope of the present invention. The scope of the present invention shall be defined only by the appended claims. In the accompanying drawings, like reference numerals denote like components throughout the plurality of figures.

Embodiment 1

Embodiments of the present invention will now be described with reference to the drawings.

Figure 2:
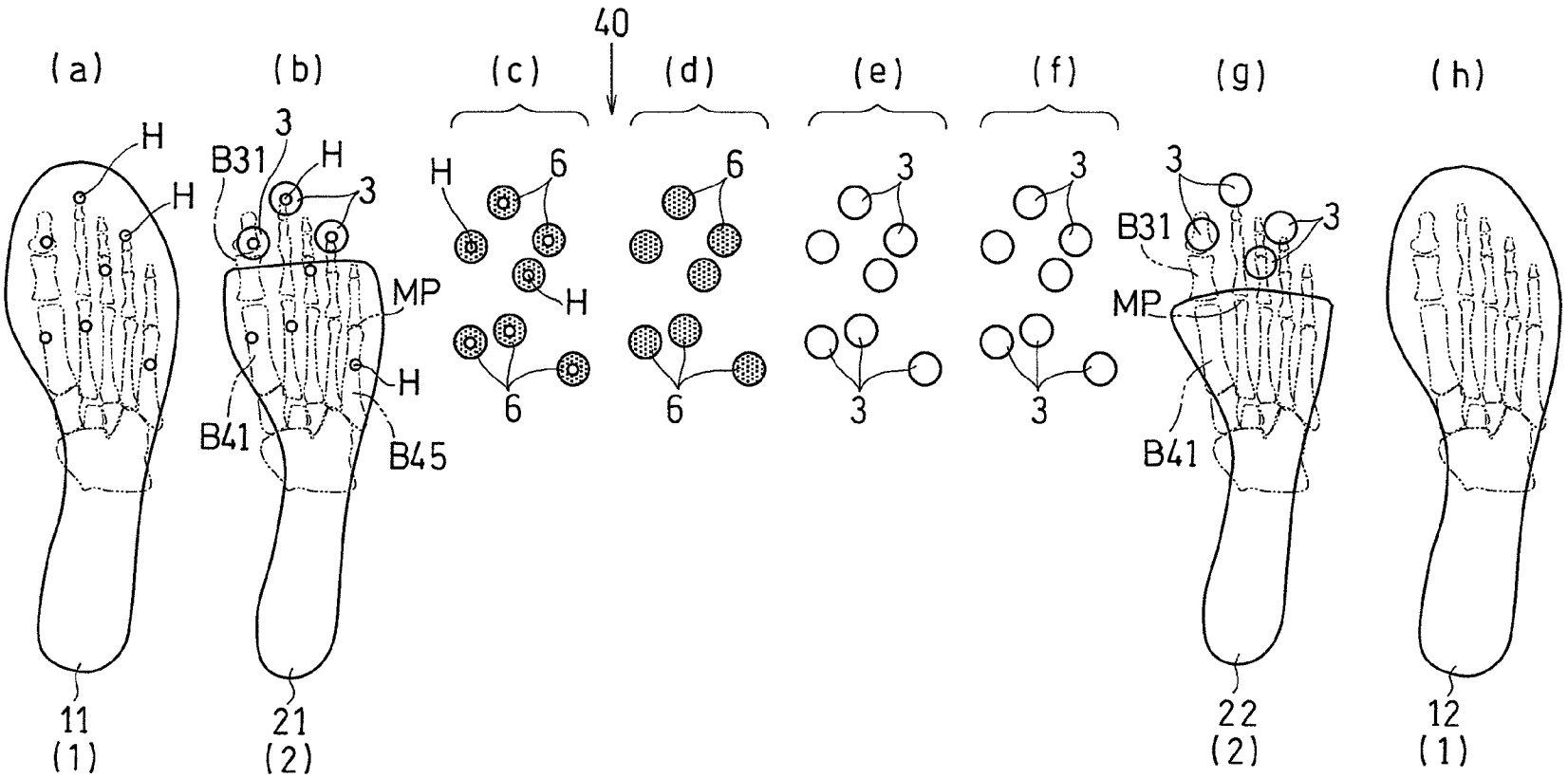
FIG. 2 is an exploded plan view showing an example of how pre-pregs and a film-shaped adhesive sheet are laminated together (Embodiment 1).
Figure 3:
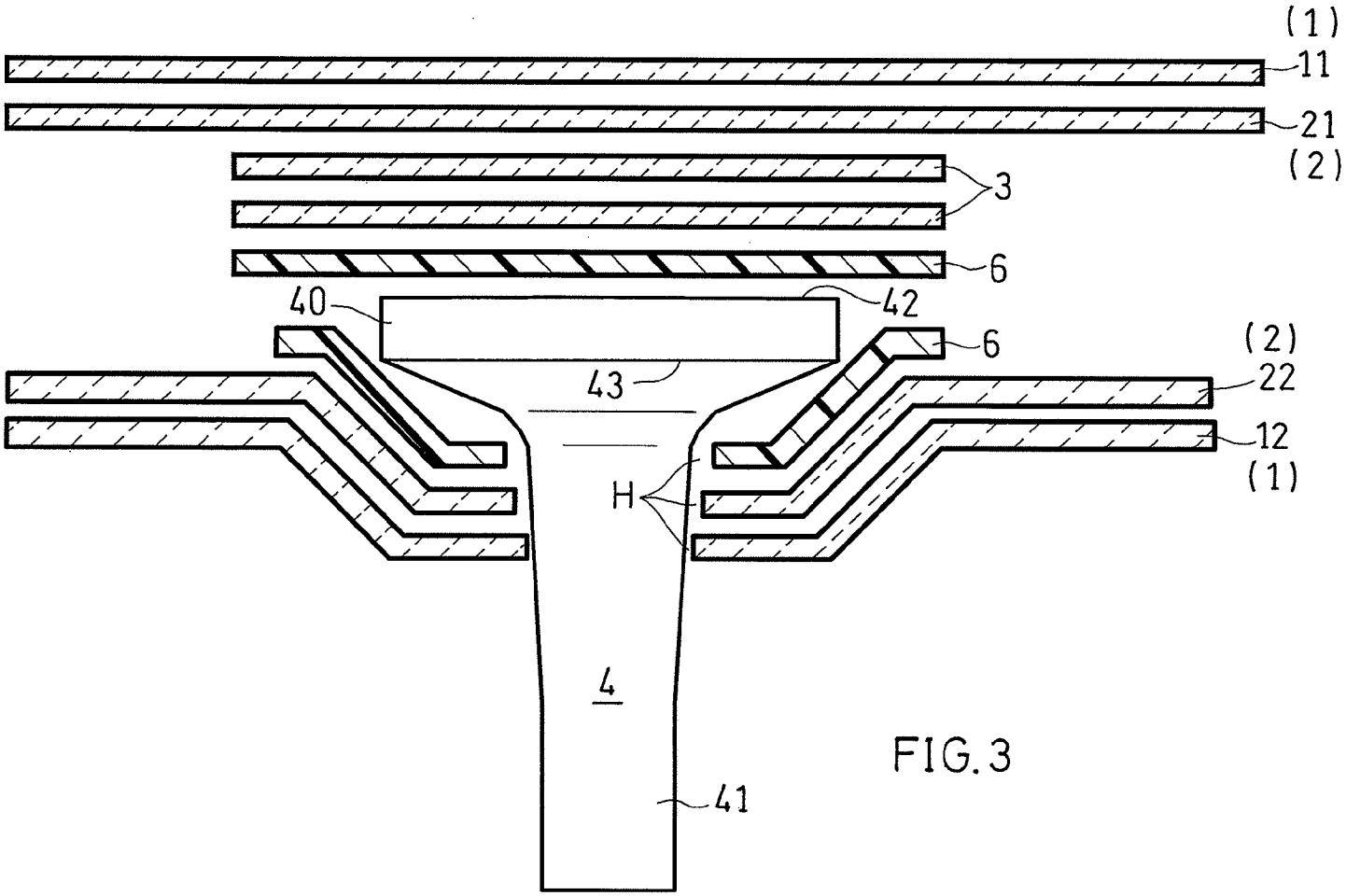
FIG. 3 is an exploded cross-sectional view showing an example of how pre-pregs and a film-shaped adhesive sheet are laminated together (Embodiment 1).

FIGS. 1 to 3 show Embodiment 1.

The present spike sole shown in FIG. 1 is a spike sole for track and field, for example, and has many spikes 4 on a sole body 5 made of an FRP (fiber reinforced plastic) reinforced with fiber reinforcement. A plurality of spikes 4 are provided at least in a front foot portion 5F of the sole body 5, and a plurality of spikes 4 are also provided further in a front half portion of a middle foot portion 5M.

As shown in the enlarged cross-sectional view of FIG. 3, each spike 4 includes a circular flat-plate-shaped base 40 having the top surface 42 and a lower surface 43, and a pin 41 projecting downward from the base 40, wherein the base 40 and the pin 41 are formed integral with each other. Note that it is preferable that the spike 4 is made of a metal, and the top surface 42 and the lower surface 43 are rough surfaces.

The sole body 5 is formed by a laminate including a plurality of pre-preg sheets 1 to 3 and a plurality of adhesive films (an example of the synthetic resin sheet) 6 laminated together. As shown in FIG. 2, the adhesive films 6 are dotted.

The base 40 of FIG. 3 is sandwiched vertically by the sheets 1 to 3, and is sandwiched vertically also by the films 6. A through hole H, through which the pin 41 passes, is formed in the sheets 1, 2, and the film 6 arranged below the base 40.

In FIG. 2, the sheets 1 to 3 and the films 6 are laminated together in the order of (a) to (h) from bottom to top. The base 40 of the spike 4 is arranged between the film 6 of FIG. 2(*c*) and the film 6 of FIG. 2(*d*). Note that also in other examples, i.e., also in FIGS. 4, 5, 7 and 8, the base 40 is arranged between (c) and (d).

Now, a pre-preg is a well-known B-stage molded material obtained by impregnating a fiber reinforced material with a thermosetting or thermoplastic matrix resin to be combined with the fiber reinforced material, and allowing the curing reaction to proceed to such a degree that it can be easily laminated manually, and is composed of a fiber reinforced material, such as carbon fiber, boron fiber or aramid fiber, for example, and an epoxy resin, which is a base material. The fiber of the pre-preg preferably has a woven structure, and a plain-woven cloth may be employed, for example.

The B stage refers to a state past the well-known A stage, which is an initial reaction stage, where the material is softened but not melted by heating and where the material gets swollen in a solvent but does not dissolve therein.

A matrix resin in a composite material refers to a resin forming the base material to be combined with the reinforcing material.

The adhesive film 6 may be a material that is in the B stage at normal temperature, and has a good affinity to the matrix resin, the reinforcing material, and the top surface 42 and the lower surface 43 of the spike 4 made of a metal. The thickness of the film 6 may typically be about 0.05 mm to about 0.4 mm, and is preferably about 0.07 mm to about 0.3 mm, and most preferably about 0.1 mm to about 0.25 mm.

In FIG. 2, each drawing showing the large main reinforcement sheet 1 and the large cut-off sheet 2 shows, depicted in two-dot-chain lines, the MP joint (metatarsal phalangeal joint) MP, the proximal phalanx B31 of the big toe, the metatarsal bone B41 of the big toe, and the metatarsal bone B45 of the fifth toe, etc. The bones B31, B41 and B45 are each comprised of a base, a shaft and a head.

A base refers to a portion of each bone that is close to the posterior joint and that is slightly expanding to a greater thickness and it is referred to also as a proximal head, whereas a head refers to a portion of each bone that is close to the anterior joint and that is slightly expanding to a greater thickness and it is referred to also as a distal head. A shaft refers to a portion between the base and the head, and the thickness thereof typically changes smoothly.

Next, the arrangement of the sheets 1 to 3 and the films 6 of FIG. 2 will be described.

In the present embodiment, the main reinforcement sheet 1 is arranged in the lowermost layer and in the uppermost layer generally across the entire area of the sole body 5. That is, in the present embodiment, the main reinforcement sheet 1 includes the lower reinforcement sheet 11, being a lower part, and the upper reinforcement sheet 12 covering the lower reinforcement sheet 11 from above. The first and second cut-off sheets 21 and 22 of FIGS. 2(*b*) and 2(*g*) are laminated together while being sandwiched between the lower reinforcement sheet 11 and the upper reinforcement sheet 12.

The main reinforcement sheet 1 may be arranged spanning from the front end of the front foot portion to the rear end of the middle foot portion, and it may be absent in part or whole of the rear foot portion.

On the other hand, the first and second cut-off sheets 21 and 22 may be absent at least in areas in the vicinity of the front end of the front foot portion and may be arranged in the middle foot portion.

In the present embodiment, the front end of the first cut-off sheet 21 is positioned posterior to the front end of the proximal phalanx B31 of the big toe and anterior to the base of the metatarsal bone B41 of the big toe. The front end of the second cut-off sheet 22 is arranged posterior to the front end of the first cut-off sheet 21.

More preferably, the front ends of the first and second cut-off sheets 21 and 22 are positioned anterior to the MP joint MP.

As shown in FIGS. 2(*b*) and (*g*), in an area anterior to the front end of the cut-off sheet 2, a plurality of small, circular island-shaped sheets 3 in an island-like pattern are arranged separately for different spikes 4. The island-shaped sheets 3 and 3 cover the bases 40 of the spikes 4 (FIG. 3) from above or from below in the front foot portion.

As shown in FIGS. 2(*e*) and 2(*f*), different island-shaped sheets 3 are arranged at the position of each spike 4. That is, in each of the layers of FIGS. 2(*b*), 2(*e*), 2(*f*) and 2(*g*), the island-shaped sheets 3 are arranged separately from one another in the front-rear direction and the width direction of the foot in an island-like pattern at the areas of the spikes 4, and each island-shaped sheet 3 has a greater area than the top surface 42 of the spike 4, covering the entire area of the top surface 42 of the spike 4 or the entire periphery of the lower surface 43, as shown in FIG. 3.

Note that the island-shaped sheets 3 are arranged so as to be sandwiched between the lower reinforcement sheet 11 and the upper reinforcement sheet 12.

Each film 6 shown in FIGS. 2(*c*) and 2(*d*) has generally the same shape and the same size as the island-shaped sheet 3, and is preferably larger than the island-shaped sheet 3 so as to cover the entire area of the island-shaped sheet 3. In order to increase the adhesion strength between the fiber reinforcement of the pre-preg sheet 1, 2 or 3 and the top surface 42 or the lower surface 43, the films 6 are arranged between the top surface 42 or the lower surface 43 and the pre-preg sheets 1 to 3, for the plurality of spikes 4, and the films 6 are thicker than the thickness of the coat of the matrix resin.

That is, a film 6 in the layer of FIG. 2(*d*) is in contact with the top surface 42 and covers the top surface 42 from above, whereas a film 6 in the layer of FIG. 2(*c*) has the through hole H, is in contact with the area of the lower surface 43 excluding the area of the pin 41, and covers the lower surface 43 from below.

Note that the films 6 of each layer are arranged in an island-like pattern separated from one another in the front-rear direction and in the width direction.

In the present spike sole, a resin having a higher wear resistance than the matrix resin (e.g., a urethane resin) is laminated on the tread surface of the sole body 5 of FIG. 1. A rib extending in the front-rear direction across the middle foot portion 5M may be formed using such a urethane resin.

The peripheral portion of the sole body 5 may be thickened by using the urethane resin. This eliminates the need for a so-called "roll-up", thus facilitating the formation of the sole body 5.

Figure 4:
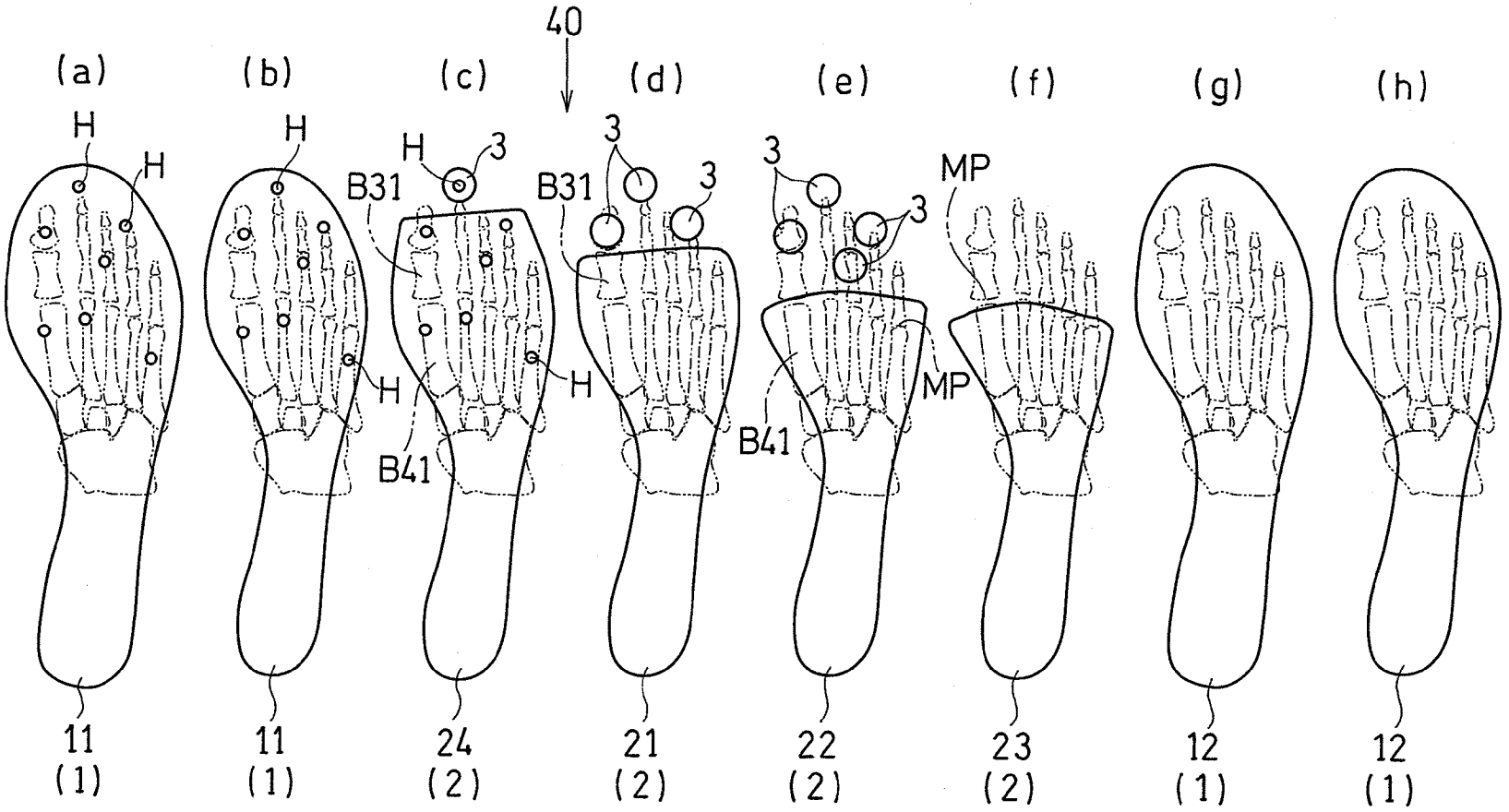
FIG. 4 is an exploded plan view showing how pre-pregs are laminated together according to Embodiment 2.

FIG. 4 shows Embodiment 2.

Note that in the following embodiments, like elements to those of Embodiment 1 described above will be denoted by like reference numerals, and will not be further described below, while describing what is different from Embodiment 1.

As shown in FIGS. 4(*a*), 4(*b*), 4(*g*) and 4(*h*), the lower reinforcement sheet 11 and the upper reinforcement sheet 12 may each be provided in a plurality of layers, or only a single main reinforcement sheet 1 may be provided. Where a plurality of main reinforcement sheets 1 are provided, the fiber orientation directions are preferably set so that the fiber orientations thereof cross each other.

As shown in FIGS. 4(*c*) to 4(*f*), third and fourth cut-off sheets 23 and 24, which are absent in the front end of the front foot portion, may be provided in addition to the first and second cut-off sheets 21 and 22. The front end of the third cut-off sheet 23 is positioned in the vicinity of the MP joint, which is posterior to the front end of the second cut-off sheet 22, whereas the front end of the fourth cut-off sheet 24 is positioned anterior to that of the first cut-off sheet 21 and anterior to the rear end of the distal phalanx of the big toe. In such a case, the flexural rigidity of the sole body 5 decreases smoothly (gradually) toward the anterior side across the MP joint MP and the front foot portion anterior thereto.

Note that the main reinforcement sheet 1 and/or the cut-off sheet 2 may each be provided in one layer.

Although the films 6 are not provided in the present embodiment, the films 6, if provided, may be provided in one layer or a plurality of layers between FIGS. 4(*c*) and 4(*d*).

Figure 5:
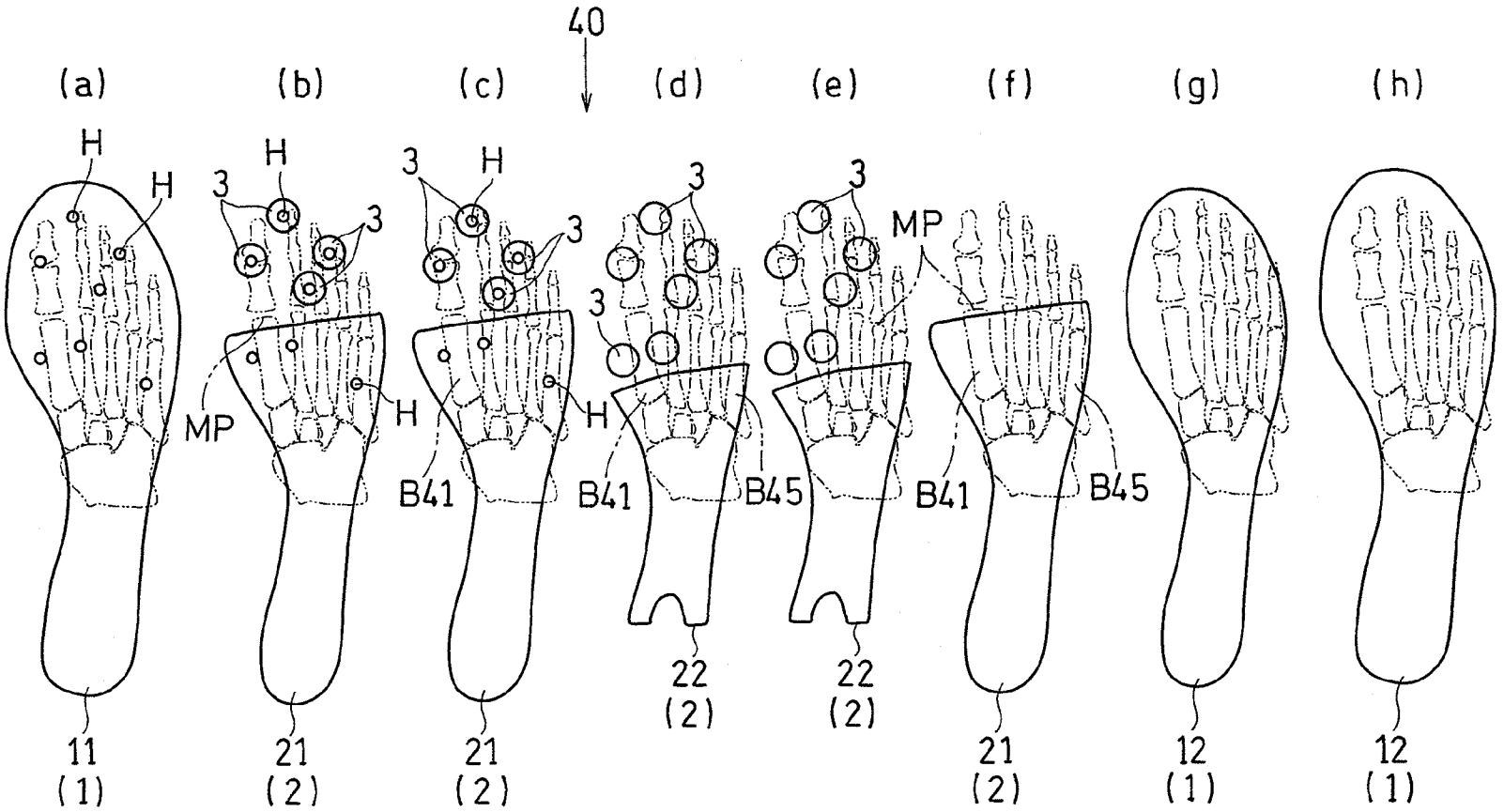
FIG. 5 is an exploded plan view showing how pre-pregs are laminated together according to Embodiment 3.

FIG. 5 shows Embodiment 3.

As shown in FIGS. 5(*b*), 5(*c*) and 5(*f*), the first cut-off sheets 21 of the same shape and the same size may be provided in a plurality of layers.

Similarly, as shown in FIGS. 5(*d*) and 5(*e*), the second cut-off sheets 22 of the same size and the same shape may be provided in a plurality of layers.

In the present embodiment, the front end of the second cut-off sheet 22 is positioned posterior to the MP joint MP and anterior to the base of the metatarsal bone B41 of the big toe and the base of the metatarsal bone B45 of the fifth toe. On the other hand, the rear end of the second cut-off sheet 22 does not cover the posterior half portion of the rear foot portion 5R though it is extending to the front end of the rear foot portion 5R. That is, the second cut-off sheet 22 extends from the rear end of the front foot portion 5F to the front end of the rear foot portion 5R to substantially cover the middle foot portion 5M. This reinforces the middle foot portion 5M where the arch of the foot is formed.

Figure 6A:
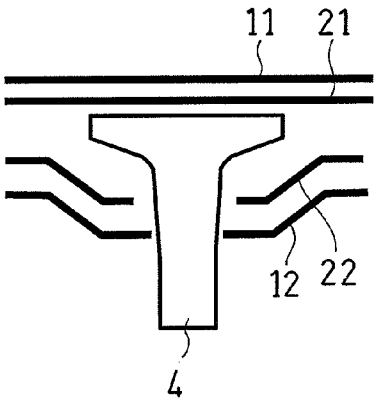
FIG. 6 is an exploded cross-sectional view showing another example of how pre-pregs are laminated together.
Figure 6B:
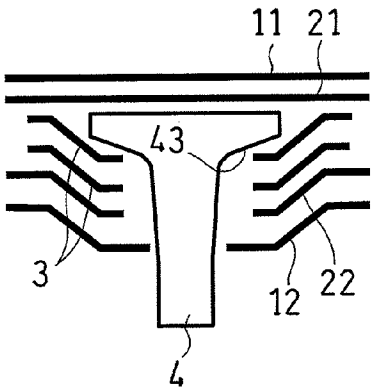
Figure 6C:
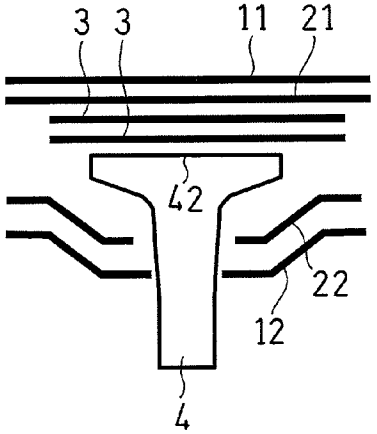

As compared with a case where the island-shaped sheets 3 are not provided as shown in FIG. 6A, in the case of FIG. 6B where two island-shaped sheets 3 are arranged under the pin 41, the strength of retaining the spikes 4 increases by about 20% to 30%, and in the case of FIG. 6C where two island-shaped sheets 3 are provided over the top surface 42, it is expected to increase by 50% or more.

Figure 6D:
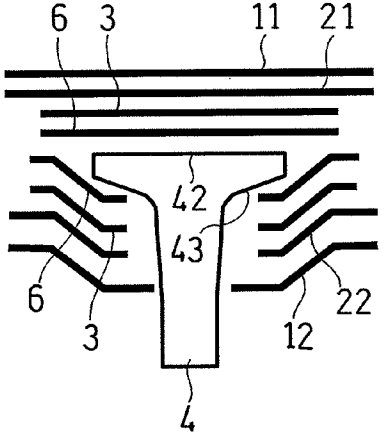

Moreover, where the film 6 and the island-shaped sheets 3 are arranged over the top surface 42 while the film 6 and the island-shaped sheets 3 are arranged under the pin 41 as shown in FIG. 6D, the spike retaining strength is expected to increase by 100% or more as compared with that in the case of FIG. 6A.

Figure 7:
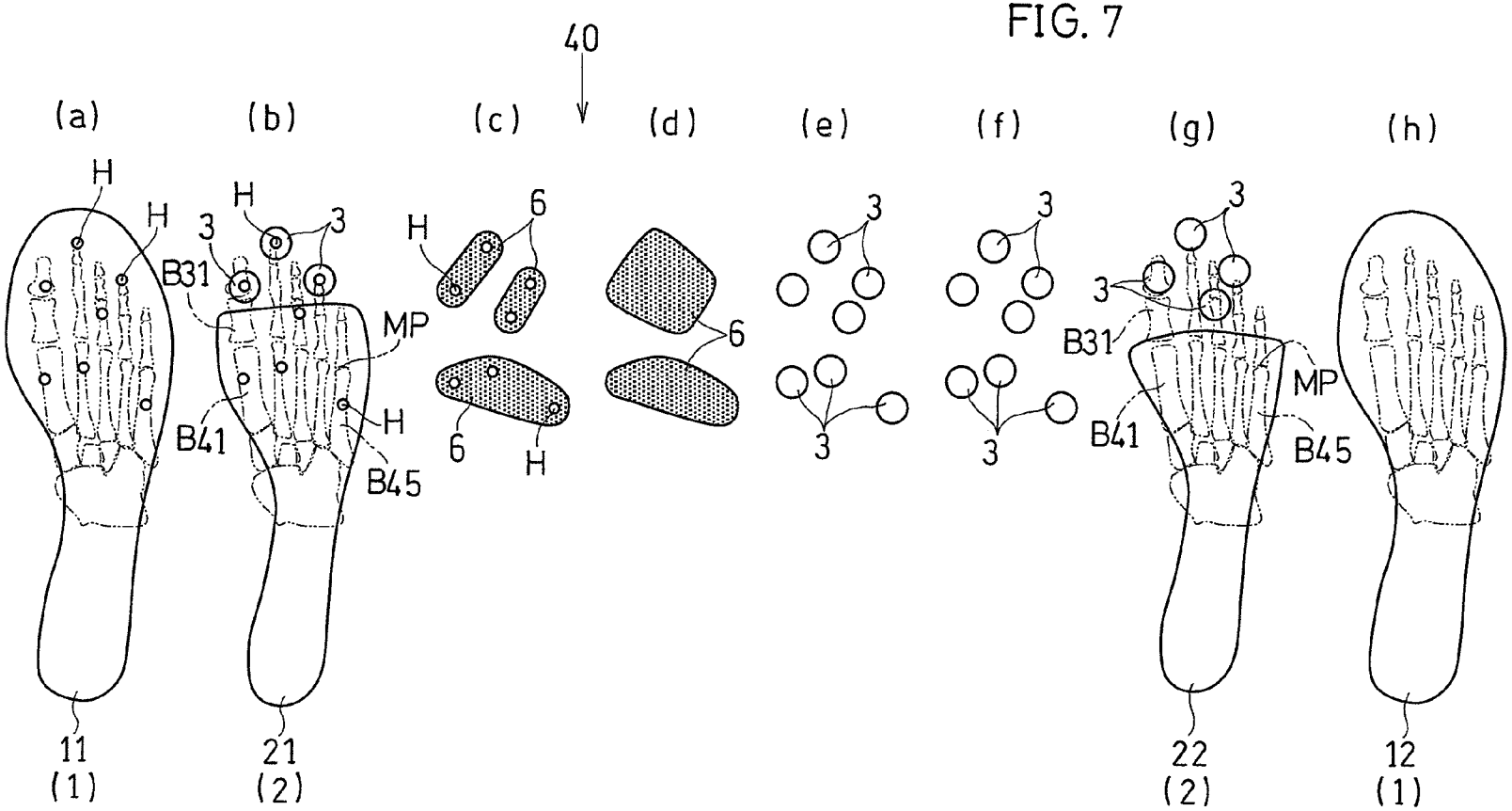
FIG. 7 is an exploded plan view showing another example of how pre-pregs and a film-shaped adhesive sheet are laminated together.

FIG. 7 shows another example of the film 6.

As shown in FIGS. 7(*c*) and 7(*d*), the films 6 are preferably spaced apart from one another in the front-rear direction of the foot, and one film 6 may cover the top surfaces 42 of two or more spikes 4. The films 6 may be provided so as to be laid on the cut-off sheet 2.

Figure 8:
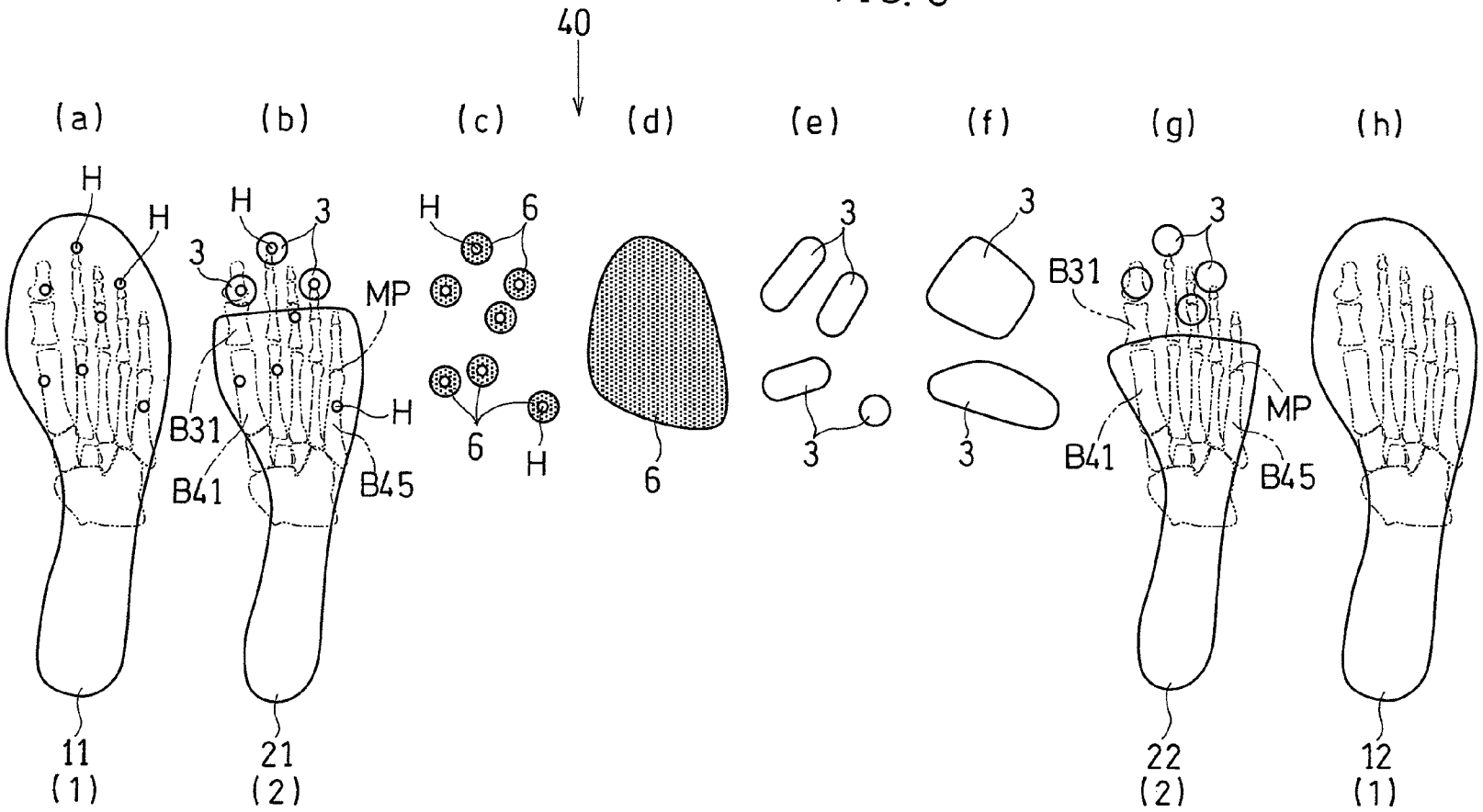
FIG. 8 is an exploded plan view showing still another example of how pre-pregs and a film-shaped adhesive sheet are laminated together.

FIG. 8 shows another example of the film 6 and the island-shaped sheets 3.

As shown in FIG. 8(*d*), the film 6 may be of such a size and shape as to cover all the spikes 4.

As shown in FIGS. 8(*e*) and 8(*f*), the island-shaped sheets 3 may each be provide so as to correspond to one or more of the spikes 4, and the island-shaped sheets 3 are preferably spaced apart from one another in the front-rear direction and/or the width direction.

While preferred embodiments have been described above with reference to the drawings, various obvious changes and modifications will readily occur to those skilled in the art upon reading the present specification.

For example, the spikes 4 may be provided in the rear foot portion as well as in the front foot portion.

The island-shaped sheets 3 and the cut-off sheet 2 do not need to be sandwiched between two main reinforcement sheets 1. Moreover, the main reinforcement sheet 1 may be provided so as to be in contact with the top surface 42 and the lower surface 43 with the film 6 interposed therebetween, and the island-shaped sheets 3 and the cut-off sheet 2 may be arranged above the upper reinforcement sheet 12 or below the lower reinforcement sheet 11.

Thus, such changes and modifications are deemed to fall within the scope of the present invention, which is defined by the appended claims.

INDUSTRIAL APPLICABILITY

The present invention is applicable to spike soles for football, or the like, as well as for track and field.

REFERENCE SIGNS LIST

1: Main reinforcement sheet
11: Lower reinforcement sheet
12: Upper reinforcement sheet
2: Cut-off sheet
21: First cut-off sheet
22: Second cut-off sheet
23: Third cut-off sheet
24: Fourth cut-off sheet
3: island-shaped sheet
4: Spike
40: Base
41: Pin
42: Top surface
43: Lower surface
5: Sole body
5F: Front foot portion
5M: Middle foot portion
5R: Rear foot portion
6: Synthetic resin sheet (adhesive film)
B31: Proximal phalanx of big toe
B41: Metatarsal bone of big toe
B45: Metatarsal bone of fifth toe

The invention claimed is:

1. A sole for a footwear, the sole comprising:
a front foot portion having a plurality of spikes, the spikes made of metal,
each of the spikes including a flat-plate-shaped base and a pin that are integrated with each other,
the base of each of the spikes is separated from one another;
a rear foot portion posterior to the front foot portion;
at least one layer of a main reinforcement sheet which is arranged spanning from a front end of the front foot portion to a rear end of a middle foot portion and made of a fiber reinforcement coated with a matrix resin, the at least one layer of the main reinforcement sheet is continuous from the front end of the front foot portion to the rear end of the middle foot portion;
a layer of a first cut-off sheet which is arranged at least in the middle foot portion and made of a fiber reinforcement coated with a matrix resin; and
a layer of a second cut-off sheet which is arranged at least in the middle foot portion and made of a fiber reinforcement coated with a matrix resin,
wherein, the at least one layer of the main reinforcement sheet, the layer of the first cut-off sheet, and the layer of the second cut-off sheet are laminated with one another,
the layer of the first cut-off sheet and the layer of the second cut-off sheet are laminated with each other in an up-and-down direction,
a front end of the first cut-off sheet is adapted to be positioned posterior to a front end of a proximal phalanx of a big toe and is adapted to be positioned anterior to a base of the metatarsal bone of the big toe,
a front end of the second cut-off sheet is adapted to be positioned posterior to a head of the proximal phalanx of the big toe and is adapted to be positioned anterior to the base of the metatarsal bone of the big toe,
a rear end of the main reinforcement sheet is arranged posterior to the front end of the first cut-off sheet,
the front end of the first cut-off sheet is arranged posterior to a front end of the main reinforcement sheet,
a rear end of the first cut-off sheet is arranged posterior to the front end of the second cut-off sheet,
the front end of the second cut-off sheet is arranged posterior to the front end of the first cut-off sheet, and
the main reinforcement sheet is arranged at such a position as to cover directly above a top surface of the flat-plate-shaped base of each of the spikes, and
at least one layer of a synthetic resin sheet, which is thicker than a thickness of each coat of the matrix resins, is sandwiched between the top surface and the main reinforcement sheet for at least one of the plurality of spikes.

2. The sole according to claim 1, wherein the layer of the synthetic resin sheet is provided in at least a portion of an area where the spikes are provided and is adapted to be unextended posterior to a base of a metatarsal bone of a fifth toe.

3. The sole according to claim 1, wherein at least a portion of the synthetic resin sheet is arranged anterior to the front end of the first cut-off sheet, and at least a portion of the synthetic resin sheet is uncovered by the first cut-off sheet and is covered by the main reinforcement sheet.

4. The sole according to claim 1, wherein a plurality of patches of the synthetic resin sheet are provided while being spaced apart from one another in a front-rear direction of a foot and unconnected with one another.

5. The sole according to claim 1, wherein for two or more of the plurality of spikes, the synthetic resin sheet is provided separately for each of the spikes.

6. The sole according to claim 1, wherein:
the at least one layer of the main reinforcement sheet comprises a plurality of layers of the main reinforcement sheet, the plurality of layers of the main reinforcement sheet includes a lower reinforcement sheet, being a lower part, and an upper reinforcement sheet covering the lower reinforcement sheet from above; and
the first and second cut-off sheets are sandwiched between the lower reinforcement sheet and the upper reinforcement sheet.

7. The sole according to claim 1, wherein:
the at least one layer of the main reinforcement sheet is laminated with layers of a plurality of island-shaped sheets which are arranged separated from one another in an island-like pattern in areas of the spikes and each of which has a greater area than a top surface of each of the spikes and is made of a fiber reinforcement coated with a matrix resin.

8. The sole according to claim 7, wherein for two or more of the spikes, the island-shaped sheets are provided and are separated from one another in a front-rear direction of a foot.

9. The sole according to claim 8, wherein at least one of the island-shaped sheets is arranged anterior to the front end of at least one of the first cut-off sheet and the second cut-off sheet, and at least one of the island-shaped sheets is uncovered by the cut-off sheet and is covered by the main reinforcement sheet.

10. The sole according to claim 9, wherein: the main reinforcement sheet comprises a lower reinforcement sheet, being a lower part, and an upper reinforcement sheet covering the lower reinforcement sheet from above; and at least one of the first cut-off sheet and the second cut-off sheet is arranged so as to be sandwiched between the lower reinforcement sheet and the upper reinforcement sheet.

11. The sole according to claim 10, wherein the island-shaped sheets are arranged sandwiched between the lower reinforcement sheet and the upper reinforcement sheet.

12. The sole according to claim 11, wherein:

the spikes comprise a flat-plate-shaped base having the top surface and a pin projecting downward from the base; and the base is sandwiched between the lower reinforcement sheet and the upper reinforcement sheet.

13. The sole according to claim 7, wherein for the plurality of spikes for which the island-shaped sheets are arranged, layers of a plurality of synthetic resin sheets thicker than a thickness of the coat of the matrix resin are provided separately from one another between the top surface and the fiber reinforcement in order to increase an adhesion strength between the fiber reinforcement and the top surface.

14. The sole according to claim 1, wherein the at least one layer of the synthetic resin sheet is provided in at least a portion of an area where the spikes are provided, and a position of a rear end of the at least one layer of the synthetic resin sheet is configured to be arranged anterior to a base of a metatarsal bone of a fifth toe.

* * * * *